US010630022B2

(12) United States Patent
Yang et al.

(10) Patent No.: US 10,630,022 B2
(45) Date of Patent: Apr. 21, 2020

(54) HIGH-SPEED CABLE CONNECTOR

(71) Applicant: Amphenol AssembleTech(Xiamen) Co.,Ltd, Xiamen (CN)

(72) Inventors: Wenchu Yang, Xiamen (CN); Dejie Kong, Xiamen (CN); Zhenxing Liu, Xiamen (CN); Hui Tang, Xiamen (CN); Weishun Chen, Xiamen (CN); Shujian Wang, Xiamen (CN)

(73) Assignee: Amphenol AssembleTech (Xiamen) Co., Ltd, Xiamen (CN)

( * ) Notice: Subject to any disclaimer, the term of this patent is extended or adjusted under 35 U.S.C. 154(b) by 0 days.

(21) Appl. No.: 16/393,974

(22) Filed: Apr. 25, 2019

(65) Prior Publication Data

US 2020/0076123 A1 Mar. 5, 2020

(30) Foreign Application Priority Data

Aug. 29, 2018 (CN) ..... 2018 2 1398555 U
Mar. 27, 2019 (CN) ..... 2019 2 0393111 U

(51) Int. Cl.
*H01R 13/627* (2006.01)
*H01R 12/53* (2011.01)
*H01R 13/633* (2006.01)

(52) U.S. Cl.
CPC ..... *H01R 13/627* (2013.01); *H01R 12/53* (2013.01); *H01R 13/633* (2013.01)

(58) Field of Classification Search
CPC .. H01R 12/53; H01R 13/627; H01R 13/6273; H01R 13/6275; H01R 13/633
See application file for complete search history.

(56) References Cited

U.S. PATENT DOCUMENTS 4,621,885 A * 11/1986 Szczesny ..... H01R 12/675 439/357
6,071,141 A * 6/2000 Semmeling ..... H01R 13/6275 439/353
6,655,979 B1 * 12/2003 Lee ..... H01R 13/6275 439/357
6,860,750 B1 * 3/2005 Wu ..... H01R 13/6275 439/357
7,083,459 B1 * 8/2006 Wu ..... H01R 13/6275 439/354
7,226,307 B1 * 6/2007 Chen ..... H01R 13/6275 439/352

(Continued)

*Primary Examiner* — Oscar C Jimenez
(74) *Attorney, Agent, or Firm* — Bayramoglu Law Offices LLC

(57) ABSTRACT

A high-speed cable connector includes a housing, a PCB fixed in the housing, a cable electrically connected to the PCB and a snap-fit member. The snap-fit member includes a main body portion and a clasp portion. The main body portion includes a fixing portion, a lever arm rotating portion formed by bending upwards from the tail end of the fixing portion, and a pressing portion fixedly connected to the end of the lever arm rotating portion. The fixing portion is fixedly installed on the top of the housing. The clasp portion includes two clasp arms on two sides of the pressing portion and fixedly connected to the pressing portion. The ends of the clasp arms are respectively provided with a clasp protruding upwards. The height of the clasp is reduced by pressing the pressing portion and the unlocking of the connector is finally completed.

19 Claims, 5 Drawing Sheets

(56) References Cited

U.S. PATENT DOCUMENTS

| | | | | |
|---|---|---|---|---|
| 7,581,978 | B1 * | 9/2009 | Briant | H01R 13/6275 439/358 |
| 10,079,449 | B1 * | 9/2018 | Chien | H01R 13/631 |
| 2001/0021602 | A1 * | 9/2001 | Zanten | H01R 13/6275 439/358 |
| 2005/0101176 | A1 * | 5/2005 | Kachlic | H01R 13/6275 439/352 |
| 2006/0030215 | A1 * | 2/2006 | Wu | H01R 24/60 439/358 |
| 2009/0130876 | A1 * | 5/2009 | Nomiyama | H01R 13/6275 439/153 |
| 2013/0052851 | A1 * | 2/2013 | Wang | H01R 13/6275 439/345 |
| 2015/0229075 | A1 * | 8/2015 | Lin | H01R 13/635 439/153 |
| 2016/0336685 | A1 * | 11/2016 | Phillips | H01R 13/6275 |
| 2018/0145450 | A1 * | 5/2018 | Wu | H01R 13/6275 |
| 2018/0294602 | A1 * | 10/2018 | Wu | H01R 13/6275 |

* cited by examiner

HIGH-SPEED CABLE CONNECTOR

CROSS REFERENCE TO THE RELATED APPLICATIONS

This application is based upon and claims priority to Chinese Patent Application No. 201821398555.6, filed on Aug. 29, 2018 and Chinese Patent Application No. 201920393111.1, filed on Mar. 27, 2019, the entire contents of which are incorporated herein by reference.

TECHNICAL FIELD

The present invention relates to the technical field of connectors, in particular to a high-speed cable connector.

BACKGROUND

The wire terminal connector and the board terminal connector in the prior art are generally connected by a clasp. When the clasp is unlocked, there are mainly two modes: an active mode and a passive mode. Specifically, in the active mode, the button is needed to be pressed manually to release the clasp, thereby achieving unlocking; and in the passive mode, an external force is applied to release the clasp, thereby achieving unlocking. The above-mentioned two modes have the following deficiencies in practical applications: in the active mode, the button is required to be pressed by hand, so a large installation space and an operation space are required for fixing the clasp and pressing the button, and the size of the corresponding connector is needed to be enlarged accordingly; in the passive mode, a small retaining force acts on the connector, so after applying a certain external force, the clasp is released and unlocked without pressing, which is prone to misoperate.

SUMMARY

With regard to the above-mentioned problems, the objective of the present invention is to provide a high-speed cable connector which has a compact, safe and reliable structure, and saves space, so as to solve the problems in the background.

In order to achieve the above-mentioned objective, the technical solution proposed by the present invention is as follows.

A high-speed cable connector includes a housing, a Printed Circuit Board (PCB) fixed inside the housing, a cable electrically connected to the PCB, and a snap-fit member. The snap-fit member includes a main body portion and a clasp portion. The main body portion includes a fixing portion, a lever arm rotating portion formed by bending upwards from a tail end of the fixing portion, and a pressing portion fixedly connected to an end of the lever arm rotating portion; and the fixing portion is fixedly installed on a top of the housing. The clasp portion includes two clasp arms; the two clasp arms is located on two sides of the pressing portion and fixedly connected to the pressing portion; two clasps protruding upwards are respectively provided on ends of the two clasp arms.

Further, the clasp portion further includes two extending arms formed by respectively extending downwards from the two sides of the pressing portion and two snap-fit point arms formed by respectively extending outward from ends of the two extending arms; one end of the clasp arm is fixedly connected to the snap-fit point arm; the extending arm and the snap-fit point arm can be a straight side or a curved side.

Further, a fixing groove for installing the fixing portion is provided at the top of the housing; the housing is provided with a clasp groove for installing the clasp portion on each side of the fixing groove; the housing is provided with a limiting arm for limiting the upward movement of the snap-fit point arm above the clasp groove.

Further, the high-speed cable connector includes a pull tab; the housing is provided with a pull tab hole below the fixing groove; a connecting hole is provided on the pressing portion; one end of the pull tab sequentially passes through the pull tab hole and the connecting hole, and is fixedly connected to the pressing portion of the snap-fit member.

Specifically, the pull tab includes a grasping portion and a connecting portion; the connecting portion of the pull tab is fixedly connected to the pressing portion of the snap-fit member; and a width of the grasping portion is greater than a width of the connecting portion.

Further, two sides of the fixing portion respectively extend outwards to form two snap-fit arms; and the housing is provided with a snap-fit groove for the insertion of the snap-fit arm on each side of the fixing groove.

Further, the housing is provided with at least one limiting blind hole at a bottom of the fixing groove, and a bottom of the fixing portion is provided with a limiting elastic plate denting downwards on a position corresponding to each limiting blind hole.

Further, a distance between the clasps on two sides is greater than or equal to a width of the pressing portion.

Further, the pressing portion is arranged in parallel to an upper surface of the housing.

Preferably, the snap-fit member is a metal snap-fit member.

Specifically, the clasp is located at a front end of the pressing portion or aligned with the front end of the pressing portion or at a rear end of the pressing portion.

Further, the housing includes a front housing and a rear housing; a rear end of the front housing is provided with a snap-fit hole; a snap-fit buckle is provided on the rear housing or at a rear end of the front housing; a snap-fit hole is provided on the rear housing to achieve a snap-fit and fixed connection; and the cable passes through a bottom of the front housing or the rear housing.

Further, the housing is filled with an inner mold for covering a soldering position of the cable and the PCB; and a side of the front housing is provided with a sprue hole for injecting of the inner mold.

Further, the front end of the front housing is provided with two inserting grooves used for the insertion of the board terminal connector.

The present invention has the following advantages: A high-speed cable connector is provided. The height of the clasp is reduced by pulling the pull tab or directly applying a force on the pressing portion and the unlocking of the connector is finally completed without an auxiliary pressing of an additional plastic. The high-speed cable connector has a compact outer shape and structure, and the process and manufacture is easy, which saves space and reduces the installation height of the product.

Figure 1:
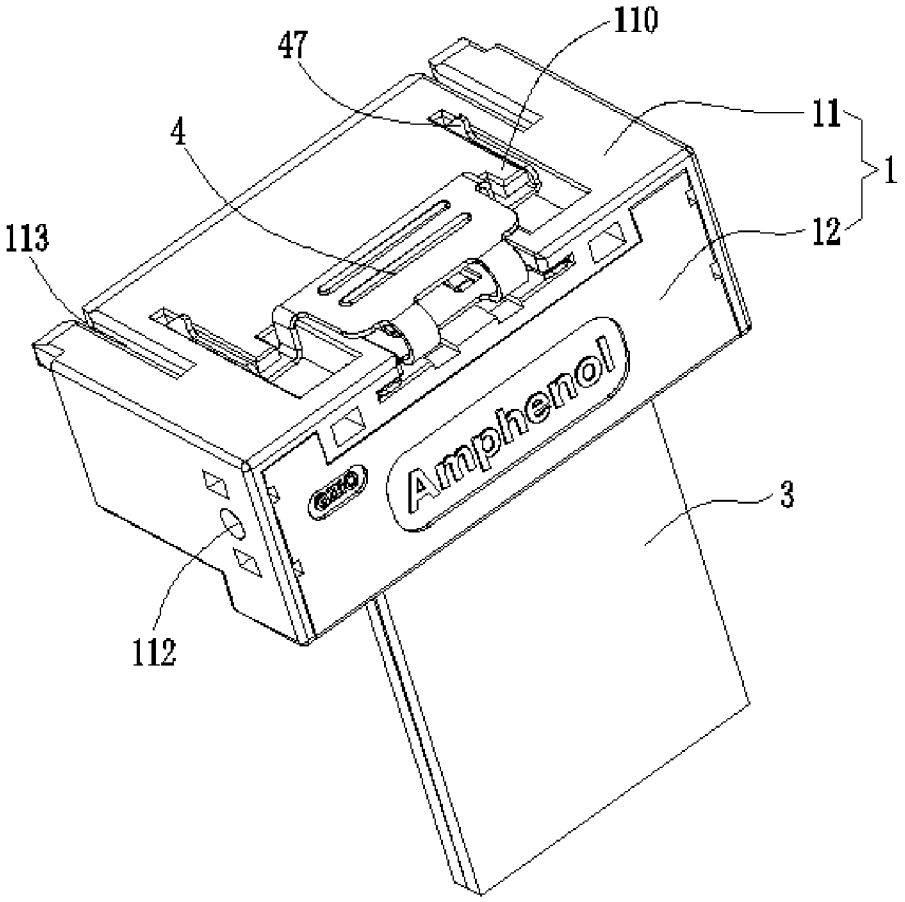
FIG. 1 is a perspective view showing a structure of a cable connector in Embodiment 1.
Figure 2:
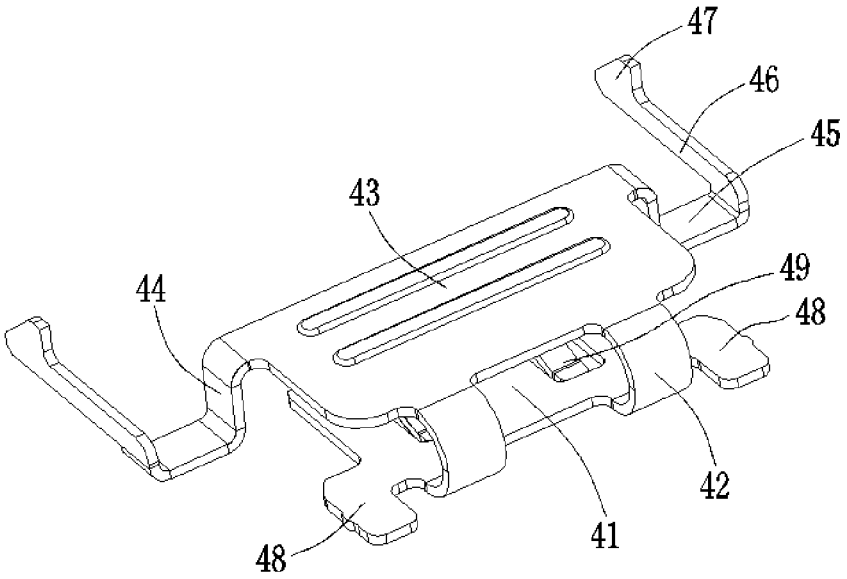
FIG. 2 is a perspective view showing a structure of a snap-fit member in Embodiment 1.
Figure 3:
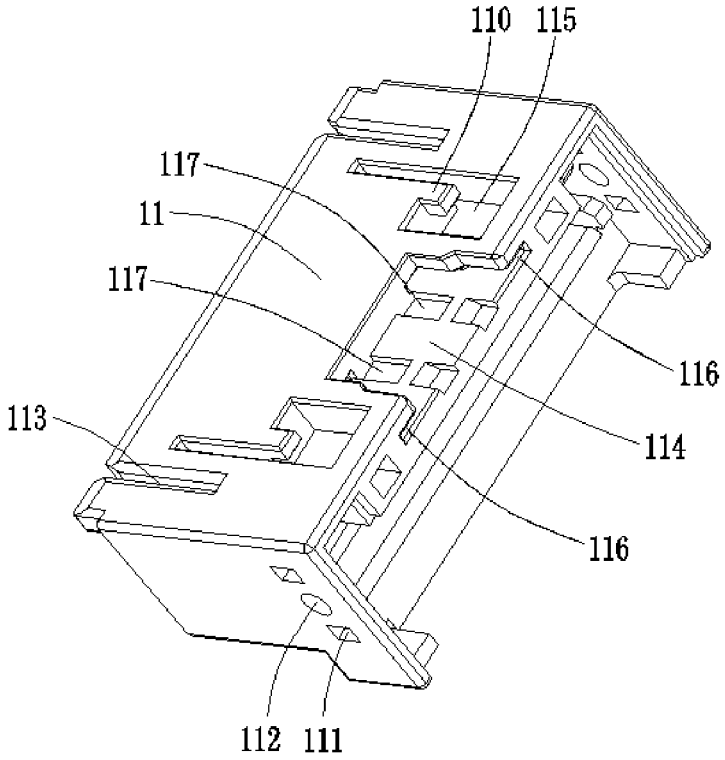
FIG. 3 is a schematic diagram showing a structure of a front housing in Embodiment 1.
Figure 4:
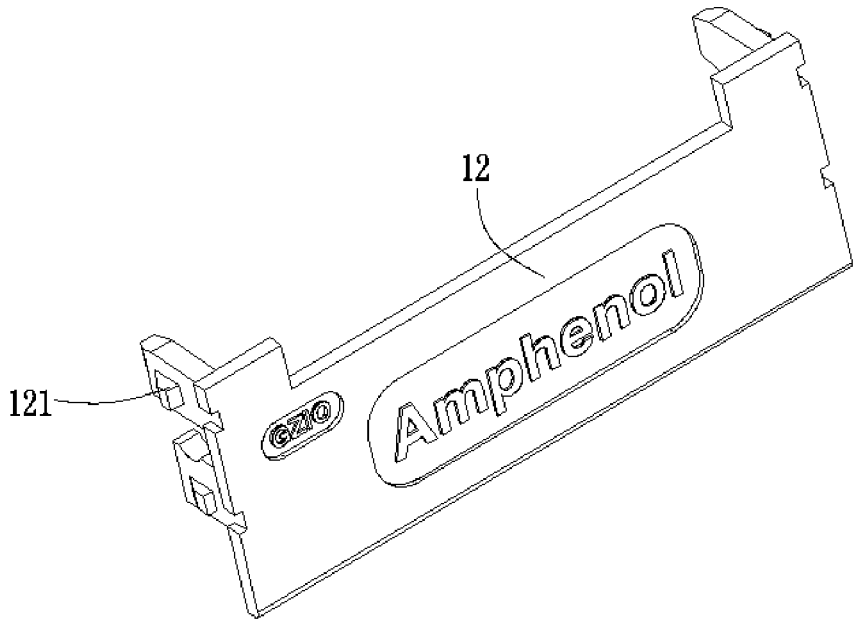
FIG. 4 is a schematic diagram showing a structure of a rear housing.
Figure 5:
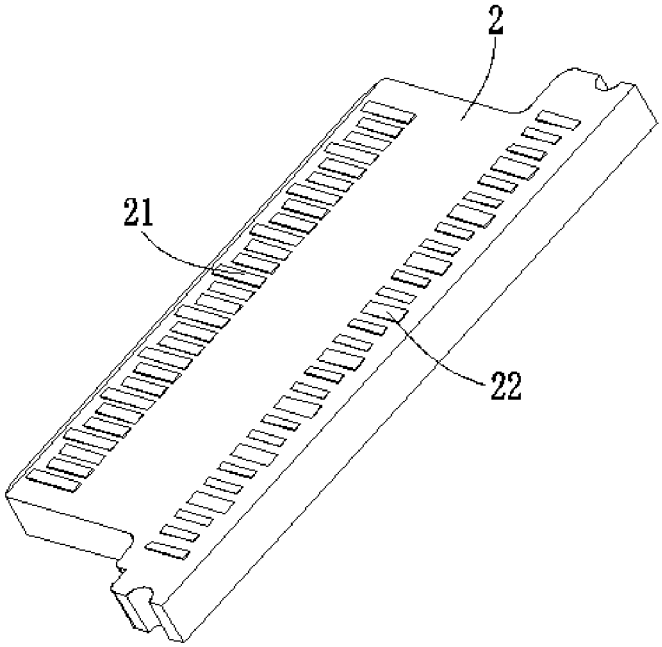
FIG. 5 is a schematic diagram showing a structure of a PCB.

The descriptions of reference numbers of the main components: 1: housing; 11: front housing; 110: limiting arm; 111: snap-fit hole; 112: sprue hole; 113: inserting groove; 114: fixing groove; 115: clasp groove; 116: snap-fit groove; 117: limiting blind hole; 118: pull tab hole; 12: rear housing; 121: snap-fit buckle; 2: PCB; 21: gold finger; 22: signal pad; 3: cable; 4: snap-fit member; 41: fixing portion; 42: lever arm rotating portion; 43: pressing portion; 431: connecting hole; 44: extending arm; 45: snap-fit point arm; 46: clasp arm; 47: clasp; 48: snap-fit arm; 49: limiting elastic plate; 5: pull tab; 51: grasping portion; 52: connecting portion.

DETAILED DESCRIPTION OF THE EMBODIMENTS

The present invention will be further described hereinafter with the drawings and the specific embodiments.

Embodiment 1

As shown in FIGS. 1-5, a high-speed cable connector includes the housing 1, the PCB 2, the cable 3, the snap-fit member 4, and the inner mold. The PCB 2 is fixedly installed inside the housing 1. The front end of the PCB 2 is provided with the gold finger 21, and the rear end of the PCB 2 is provided with a signal pad 22. The cable 3 is soldered on the signal pad 22 and covered by the inner mold at a soldering position (not shown in the drawings). The housing 1 includes the front housing 11 and the rear housing 12. The rear end of the front housing 11 is provided with the snap-fit hole 111. The rear housing 12 is provided with the snap-fit buckle 121, and is fixed on the rear end of the front housing 11 by the fitting of the snap-fit buckle 121 and the snap-fit hole 111. The cable 3 passes through the bottom of the front housing 11. The side of the front housing 11 is provided with the sprue hole 112. The front end of the front housing 11 is provided with the two inserting grooves 113.

The snap-fit member 4 includes the main body portion and the clasp portion. The main body portion and the clasp portion are made of metal materials. The main body portion includes the fixing portion 41, the lever arm rotating portion 42 and the pressing portion 43. The tail end of the fixing portion 41 is bent upwards to form the semicircular lever arm rotating portion 42. The end of the rotating portion 42 extends forwards to form the pressing portion 43. The pressing portion 43 is parallel to the upper surface of the front housing 11. The clasp portion includes the two extending arms 44, the two snap-fit point arms 45 and the two clasp arms 46. The sides of the front end of the pressing portion 43 extend downwards to form the two extending arms 44. The two extending arms 44 respectively extend toward the outer side of the pressing portion 43 to form the two snap-fit point arms 45. One end of each clasp arm 46 is fixedly connected to the tail end of each snap-fit arm 45, and the other end protrudes upwards to form the clasp 47. The distance between the two clasps 47 is greater than the width of the pressing portion 43.

The fixing groove 114 is provided at the top of the front housing 11. The top of the front housing 11 is provided with a clasp groove 115 on each side of the fixing groove 114. The fixing portion 41 of the snap-fit member 4 is fixedly installed in the fixing groove 114. The clasp portions on the two sides of the snap-fit member 4 are respectively embedded and installed inside the two clasp grooves 115. The limiting arm 110 for limiting the upward movement of the snap-fit point arm 45 is provided above the clasp groove 115. The two sides of the fixing portion 41 respectively extend outwards to form the two snap-fit arms 48. The front housing 11 is respectively provided with the snap-fit groove 116 for the insertion of the snap-fit arm 41 on each side of the fixing groove 114. The front housing 11 is provided with the two limiting blind holes 117 at the bottom of the fixing groove 114. The bottom of the fixing portion 41 is provided with the limiting elastic plate 49 denting downwards at a position corresponding to each of the limiting blind holes 117.

Figure 6:
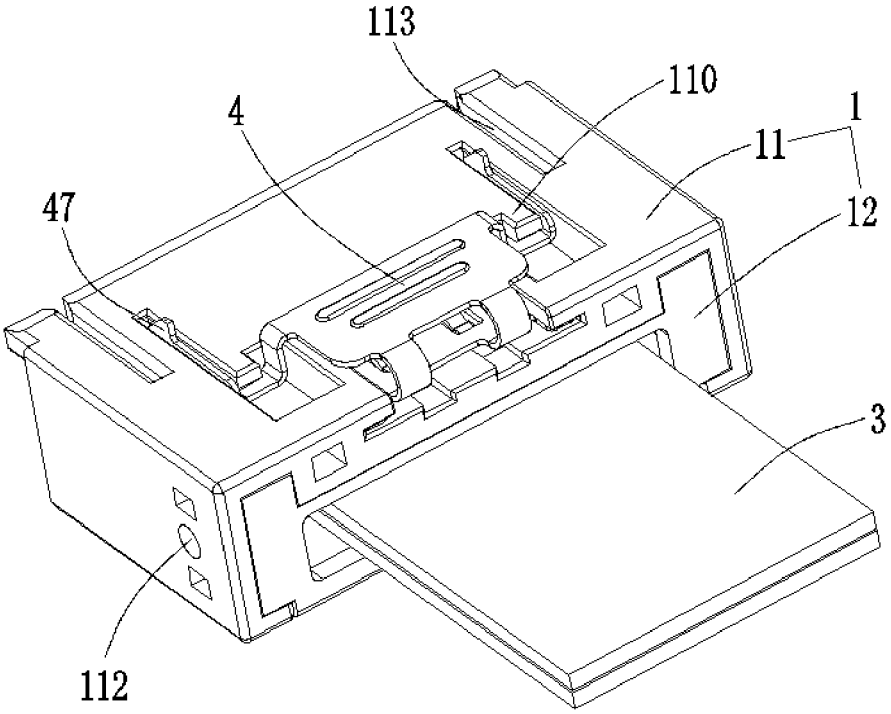
FIG. 6 is a perspective view showing a structure of a cable connector in Embodiment 2.
Figure 7:
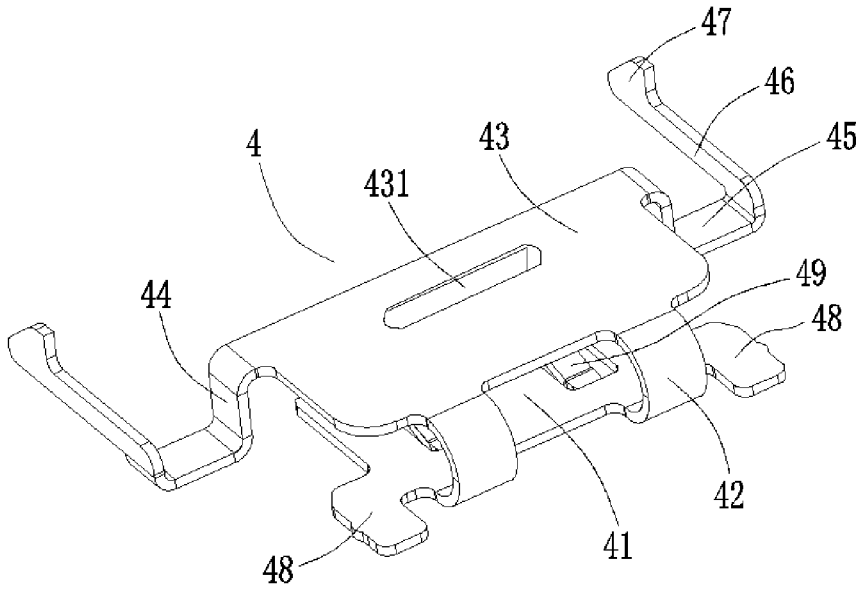
FIG. 7 is a perspective view showing a structure of a snap-fit member in Embodiment 2.
Figure 8:
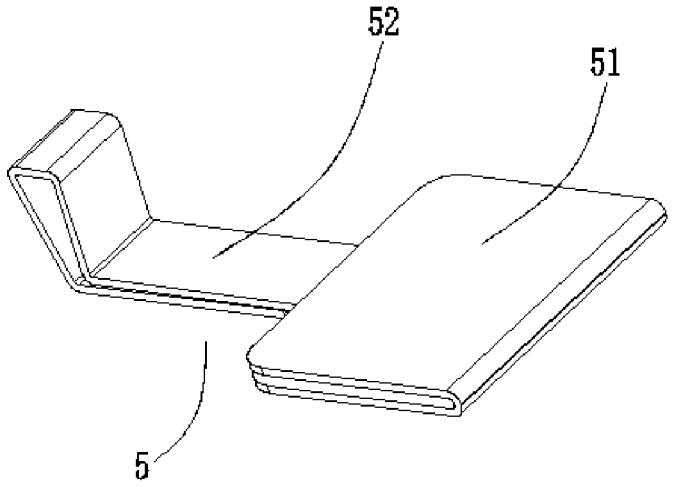
FIG. 8 is a schematic diagram showing a structure of a pull tab.
Figure 9:
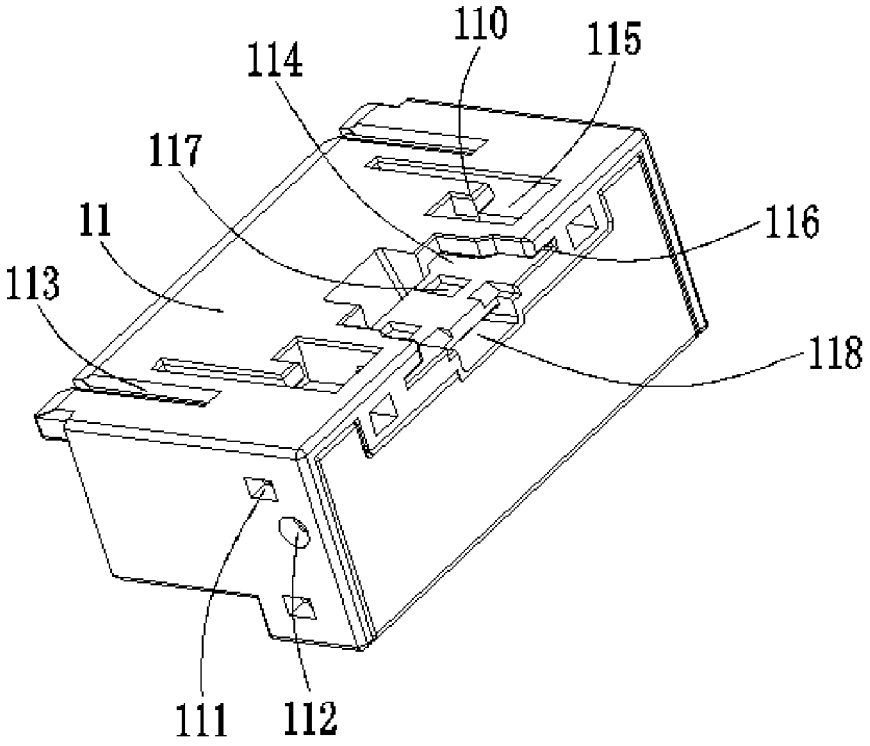
FIG. 9 is a schematic diagram showing a structure of a front housing in Embodiment 2.

FIG. 6 is a schematic diagram showing that the snap-fit member 4 is installed on the product with a straight arm, and the cable 3 passes through the rear housing 12.

The operation principle of the present invention is as follows: by applying force to the pressing portion 43, the force acts on the lever arm rotating portion 42; then the corresponding pressing portion 43, the left and right extending arms 44, the left and right snap-fit point arms 45, and the left and right clasp arms 46 mutually transmit the force to realize lever rotation by the lever arm rotation portion 42; meanwhile, a height of the clasp 47 is decreased; when pressing to a certain distance, the clasp 47 no longer locks, and the connector can be detached from the matched connector.

Embodiment 2

As shown in FIGS. 6-9, the differences between the present embodiment and Embodiment 1 are as follows. The high-speed cable connector includes the housing 1, the PCB 2, the cable 3, the snap-fit member 4, the pull tab 5 and an inner mold. The housing 1 is provided with the pull tab hole 118 below the fixing groove 114. The connecting hole 431 is provided on the pressing portion 43. The pull tab 5 includes the grasping portion 51 and the connecting portion 52. The width of the grasping portion 51 is larger than the width of the connecting portion 52. The connecting portion 52 of the pull tab 5 sequentially passes through the pull tab hole 118 and the connecting hole 431, and is fixedly connected to the pressing portion 43. The remainder structures of the present embodiment are the same as that of Embodiment 1.

The operation principle of the embodiment is as follows. When the grasping portion 51 of the pull tab 5 is pulled, the grasping portion 51 transmits the tensile force to the pressing portion 43 by the connecting portion 52. The pressing portion 43 moves downward to act on the lever arm rotating portion 42, and then the corresponding pressing portion 43, the left and right extending arms 44, the left and right snap-fit point arms 45, and the left and right clasp arms 46 mutually transmit the force to realize a lever rotation by the lever arm rotation portion 42. Meanwhile, a height of the clasp 47 is decreased accordingly. When pressing to a certain distance, the clasp 47 no longer locks, and the connector can be detached from the matched connector.

Although the present invention is specifically illustrated and described with the preferred embodiments, the person skilled in the art should understand that various modifications in form and detail made within the spirit and scope defined by the appended claims in the present invention are within the protection scope of the present invention.

What is claimed is:

1. A high-speed cable connector, comprising: a housing, a Printed Circuit Board (PCB) fixed inside the housing, a cable electrically connected to the PCB, and a snap-fit member, wherein the snap-fit member comprises a main body portion and a clasp portion; the main body portion comprises a fixing portion, a lever arm rotating portion formed by bending upwards from a tail end of the fixing portion, and a pressing portion fixedly connected to an end of the lever arm rotating portion; the fixing portion is fixedly installed on a top of the housing; the clasp portion comprises two clasp arms; the two clasp arms are located on two sides of the pressing portion and fixedly connected to the pressing portion; and two clasps protruding upwards are respectively provided on ends of the two clasp arms, wherein the clasp portion further comprises two extending arms formed by respectively extending downwards from the two sides of the pressing portion, and two snap-fit point arms formed by respectively extending outward from ends of the two extending arms; and one end of the clasp arm is fixedly connected to the snap-fit point arm, the housing is provided with a clasp groove for installing the clasp portion on each of two sides of a fixing groove; and the housing a provided with a limiting arm for limiting an upward movement of the snap-fit point arm above the clasp groove.

2. The high-speed cable connector according to claim 1, wherein the fixing groove for installing the fixing portion is provided at the top of the housing.

3. The high-speed cable connector according to claim 2, wherein the high-speed cable connector further comprises a pull tab; the housing is provided with a pull tab hole below the fixing groove; a connecting hole is provided on the pressing portion; one end of the pull tab sequentially passes through the pull tab hole and the connecting hole, and is fixedly connected to the pressing portion of the snap-fit member.

4. The high-speed cable connector according to claim 3, wherein the pull tab comprises a grasping portion and a connecting portion; the connecting portion of the pull tab is fixedly connected to the pressing portion of the snap-fit member; and a width of the grasping portion is greater than a width of the connecting portion.

5. The high-speed cable connector according to claim 4, wherein the clasp is located at a front end of the pressing portion or aligned with the front end of the pressing portion or at a rear end of the pressing portion.

6. The high-speed cable connector according to claim 3, wherein the clasp is located at a front end of the pressing portion or aligned with the front end of the pressing portion or at a rear end of the pressing portion.

7. The high-speed cable connector according to claim 2, wherein two sides of the fixing portion respectively extend outwards to form two snap-fit arms; and the housing is provided with a snap-fit groove for the insertion of the snap-fit arm on each of the two sides of the fixing groove.

8. The high-speed cable connector according to claim 7, wherein the clasp is located at a front end of the pressing portion or aligned with the front end of the pressing portion or at a rear end of the pressing portion.

9. The high-speed cable connector according to claim 2, wherein the housing is provided with at least one limiting blind hole at a bottom of the fixing groove, and a bottom of the fixing portion is provided with a limiting elastic plate denting downwards on a position corresponding to each limiting blind hole.

10. The high-speed cable connector according to claim 9, wherein the clasp is located at a front end of the pressing portion or aligned with the front end of the pressing portion or at a rear end of the pressing portion.

11. The high-speed cable connector according to claim 2, wherein the clasp is located at a front end of the pressing portion or aligned with the front end of the pressing portion or at a rear end of the pressing portion.

12. The high-speed cable connector according to claim 1, wherein the clasp is located at a front end of the pressing portion or aligned with the front end of the pressing portion or at a rear end of the pressing portion.

13. The high-speed cable connector according to claim 1, wherein a distance between the clasps on two sides is greater than or equal to a width of the pressing portion.

14. The high-speed cable connector according to claim 1, wherein the pressing portion is arranged in parallel to an upper surface of the housing.

15. The high-speed cable connector according to claim 1, wherein the snap-fit member is a metal snap-fit member.

16. The high-speed cable connector according to claim 1, wherein the clasp is located at a front end of the pressing portion or aligned with the front end of the pressing portion or at a rear end of the pressing portion.

17. The high-speed cable connector according to claim 16, wherein the housing comprises a front housing and a rear housing; a rear end of the front housing is provided with a snap-fit hole; a snap-fit buckle is provided on the rear housing or at a rear end of the front housing; a snap-fit hole is provided on the rear housing to achieve a snap-fit and fixed connection; and the cable passes through a bottom of the front housing or the rear housing.

18. The high-speed cable connector according to claim 17, wherein a front end of the front housing is provided with two inserting grooves used for the insertion of the board terminal connector.

19. The high-speed cable connector according to claim 16, wherein the housing is filled with an inner mold for covering a soldering position of the cable and the PCB; and a side of the front housing is provided with a sprue hole for injecting of the inner mold.

* * * * *